US006601758B2

(12) United States Patent
Lizzio

(10) Patent No.: US 6,601,758 B2
(45) Date of Patent: Aug. 5, 2003

(54) CONTAINER FOR TRANSPORTING HEATED FOOD, PARTICULARLY PIZZA AND THE LIKE

(75) Inventor: Filippo Lizzio, Turin (IT)

(73) Assignee: Termopizza Srl, Donnas (Aosta) (IT)

( * ) Notice: Subject to any disclaimer, the term of this patent is extended or adjusted under 35 U.S.C. 154(b) by 110 days.

(21) Appl. No.: 09/963,393

(22) Filed: Sep. 27, 2001

(65) Prior Publication Data

US 2002/0040862 A1 Apr. 11, 2002

(30) Foreign Application Priority Data

Sep. 28, 2000 (IT) ..... TO2000A0900
Jan. 19, 2001 (IT) ..... TO20010008 U

(51) Int. Cl.[7] ..... B65D 5/42

(52) U.S. Cl. ..... 229/120; 229/902; 229/906; 426/124; 426/128

(58) Field of Search ..... 229/120, 406, 229/407, 902, 906; 206/565, 765; 220/625, 630; 426/115, 124, 128, 129, 130

(56) References Cited

U.S. PATENT DOCUMENTS

| | | | | | |
|---|---|---|---|---|---|
| 3,026,209 | A | * | 3/1962 | Niblack et al. | 426/124 |
| 3,515,331 | A | * | 6/1970 | Guthrie, Sr. | 426/128 |
| 4,197,940 | A | * | 4/1980 | DeRossett | 229/906 |
| 4,441,626 | A | * | 4/1984 | Hall | 229/120 |
| 4,883,195 | A | * | 11/1989 | Ott et al. | 229/406 |
| 5,052,559 | A | * | 10/1991 | Bressi, Jr. | 229/120 |
| 5,385,292 | A | * | 1/1995 | Labianca et al. | 229/120 |
| 5,445,286 | A | * | 8/1995 | Guimarin | 229/902 |
| 5,482,724 | A | * | 1/1996 | Morici et al. | 426/124 |
| 5,588,587 | A | * | 12/1996 | Stier et al. | 229/906 |
| 5,895,698 | A | * | 4/1999 | Cacciatore et al. | 229/906 |

FOREIGN PATENT DOCUMENTS

EP 989067 A1 * 3/2000

* cited by examiner

*Primary Examiner*—Gary E. Elkins
(74) *Attorney, Agent, or Firm*—Sughrue Mion, PLLC

(57) ABSTRACT

Container for transporting heated food, particularly pizza and the like, comprising in combination an outer vessel and a tray of heat-formed plastic material. The tray has a base wall formed with ribs projecting from its upper face and from its lower face, respectively.

7 Claims, 4 Drawing Sheets

CONTAINER FOR TRANSPORTING HEATED FOOD, PARTICULARLY PIZZA AND THE LIKE

FIELD OF THE INVENTION

The present invention is related to containers for transporting heated food, particularly pizzas, hamburgers and more generally fast-food products.

These food products, purchased in a warm condition at the production site and then transferred to the place where they shall be taken, are subjected not only to progressive cooling but also to contamination by the steam generated thereby and then condensed following cooling.

The transporting containers presently used, traditionally consisting of simple cardboard boxes, are all affected by the above-referenced drawback, whereby the organoleptic characteristics of the food products housed therein are more or less lowered, often without any chances to be restored not even by subjecting the foodstuffs to further heating.

A further critical inconvenience of the conventional containers consisting of simple cardboard boxes resides in that these containers are permeable to any fluid substances coming out during transportation from the foodstuffs contained therein, with a consequent risk of leakage and pouring of those fluid substances to the outside.

An extremely efficient and functional solution to the above-referenced problems is provided in EP-A-0989067, and consists of a unique container formed by a first and a second half-shell of moulded plastic material adapted to be sealingly coupled to each other and defining therebetween a cavity for containing a pizza or the like in a spaced-apart condition relative to the bottom walls of the half-shells. Containers successfully produced according to the above prior document are capable to ensure both preservation of temperature and fragrance and absence of moisture of the warm food product contained therein, even during a surprisingly long time. However their cost, relatively higher than the cost of simple cardboard boxes, might be preventing a commercial diffusion thereof on a large scale.

SUMMARY OF THE INVENTION

A first object of the present invention is to overcome the latter drawback, and more particularly to provide a container for transporting pizza and the like which is capable to overcome the defects of the traditional containers, with results comparable to those achieved by the container known from EP-A-0989067, however with lower manufacturing costs.

A second object of the present invention is to further improve the container known from EP-A-0989067.

According to the invention these objects are achieved by a container the main feature of which is defined in appended claim 1.

Additional secondary features of the container according to the invention are defined in sub-claims 2–6.

The provision of the inner tray advantageously enhances functionality of the outer vessel essentially by virtue of the fact that the warm foodstuff has no direct contact with the lower wall of the container but is instead thermally isolated relative thereto by the interspace defined, in use, between the bottom wall of the container and the tray, while the latter is anyhow firmly bearing upon said bottom wall. This prevents over-heating of the container bottom which, while ensuring better structural stability of the container, makes transportation thereof more convenient to the user.

BRIEF DESCRIPTION OF THE DRAWINGS

The invention will now be disclosed in detail with reference to the accompanying drawings, purely provided by way of non limiting example, in which.

DETAILED DESCRIPTION OF THE INVENTION

Figure 1:
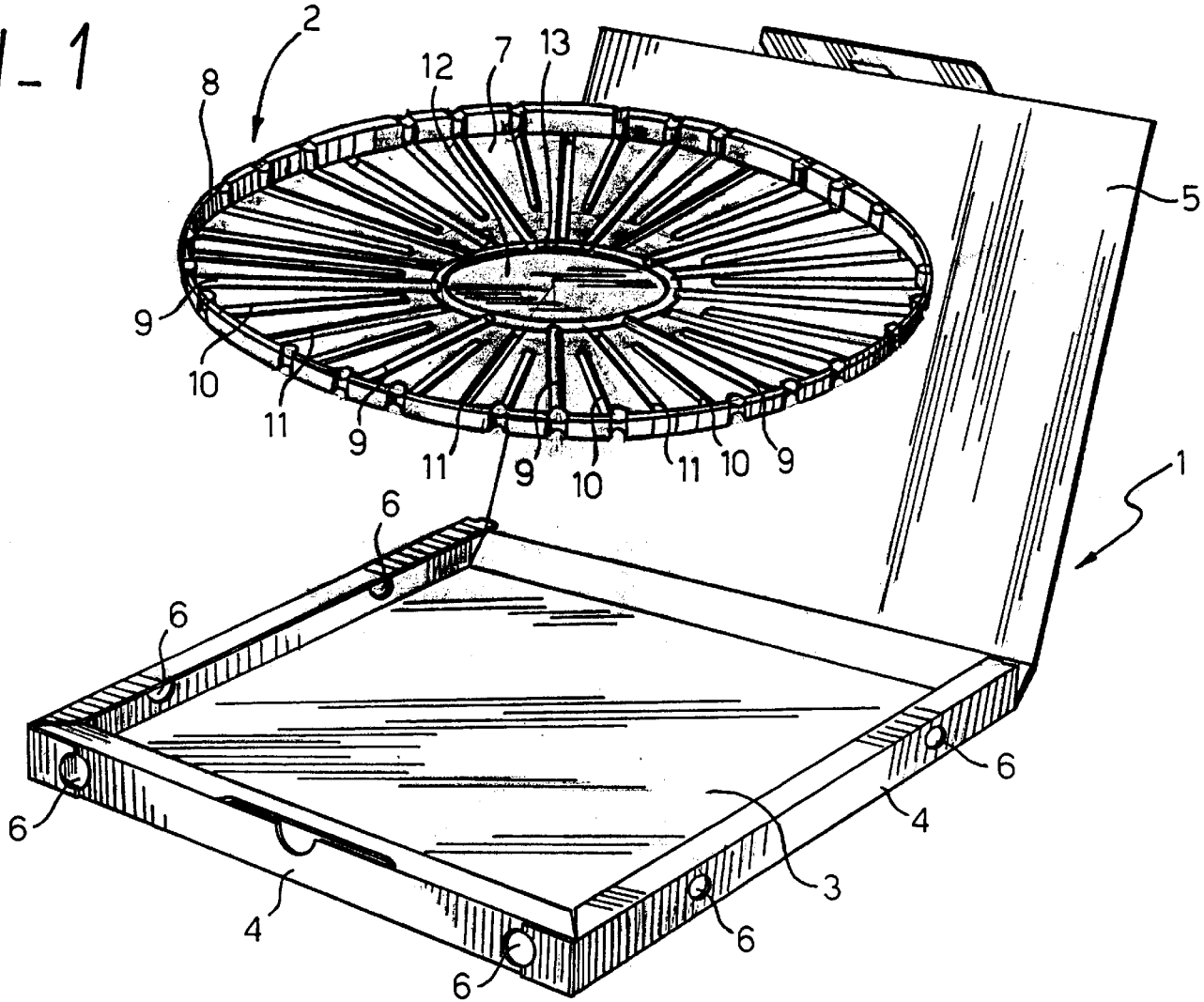
FIG. 1 is an exploded perspective view of a container for transporting heated food according to the invention.
Figure 2:
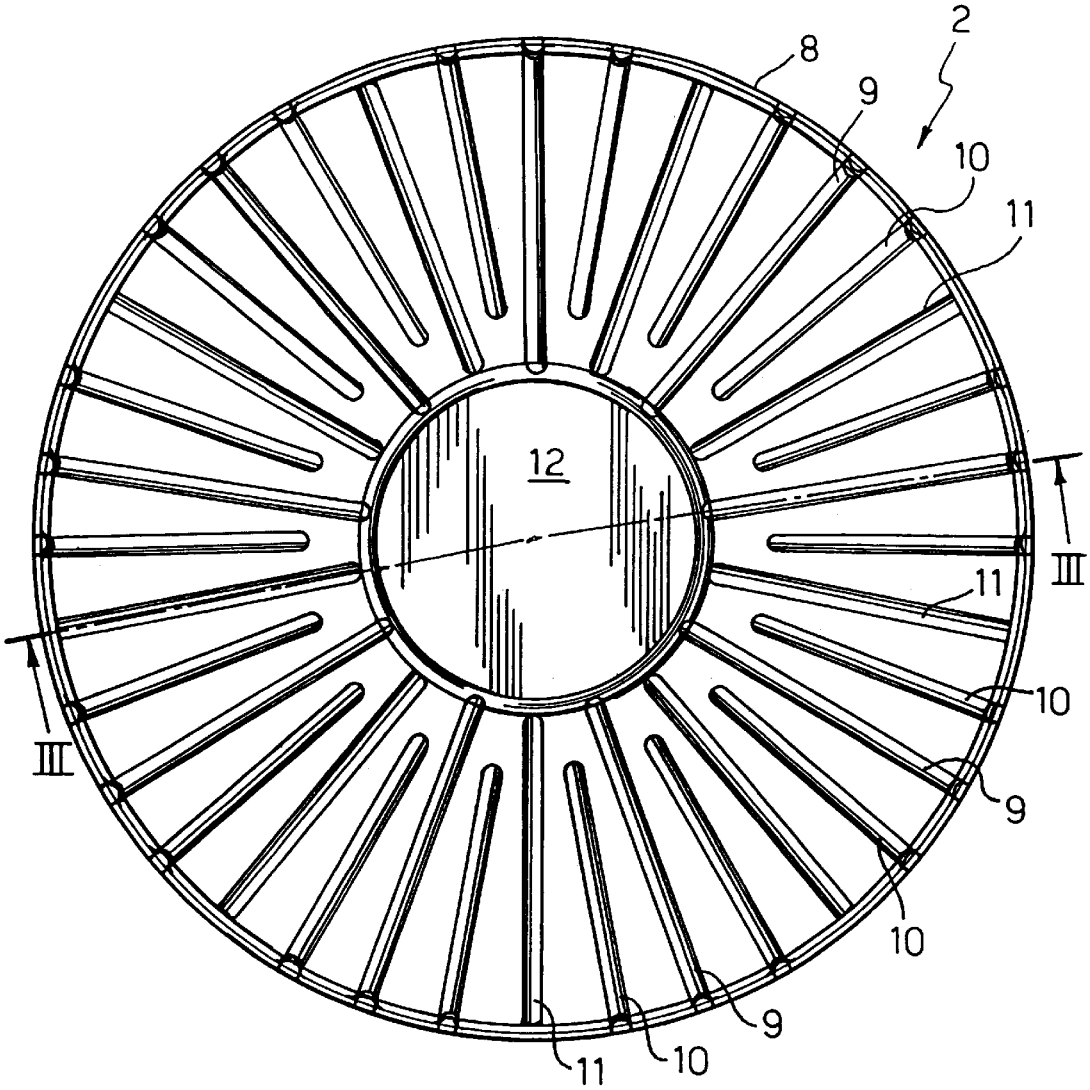
FIG. 2 is a top plane view in an enlarged scale of one of the container elements.
Figure 3:
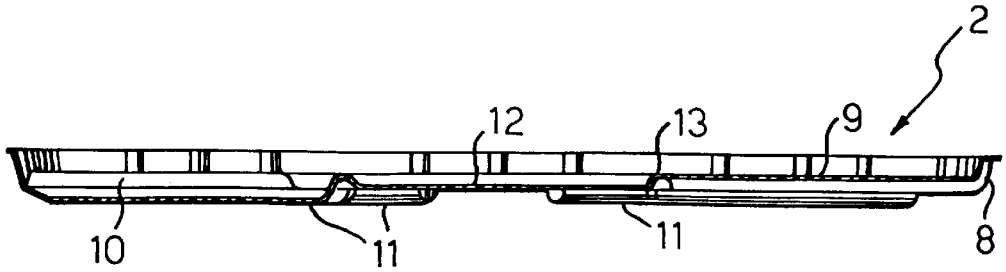
FIG. 3 is a lateral elevational view of FIG. 2.

Referring to the FIGS. 1–4, a container for transporting heated food, particularly a pizza P (FIG. 4) and the like, essentially comprises an outer vessel consisting of a cardboard box 1, and an inner receptacle constituted by a plastic material tray 2. The cardboard box is almost well known and conventional in the subject applications: it has a generally flattened parallelepipedal design, with a square plan, having a bottom wall 3, lateral walls 4 and an openable cover or lid 5. The lateral walls 4, and possibly also the lid 5, may be provided with vent openings 6 through which, when the lid 5 is closed, the cavity of the box 1 is communicating with the outer environment.

The tray 2 is formed by a thin sheet of polypropylene or the like heat-formed plastic material. It has a circular design, with a base wall 7 delimited by a raised perimetral edge 8. It is to be pointed out that the arrangement of the raised edge 8 shown in the drawings is purely indicative, since this edge may be provided with a more or less terminal bent portion, even locally designed so as to facilitate separation between mutually superimposed and stacked trays 2.

The tray 2, which as stated is manufactured by a heat-forming process, is provided with a number of first and second ribs projecting from its upper and from its lower face, respectively, and arranged in a radial array fashion.

The first radial ribs, i.e. those projecting from the upper face of the base wall 7, include longer ribs 9 and shorter ribs 10 arranged, in the case of the shown example, three by three. Both the longer ribs 9 and the shorter ribs 10 start from the raised perimetral edge 8, and the former terminate at a central annular rib 13 circumscribing a relatively wide flat surface 12 which can be employed, for example, for receiving advertising material.

Figure 4:
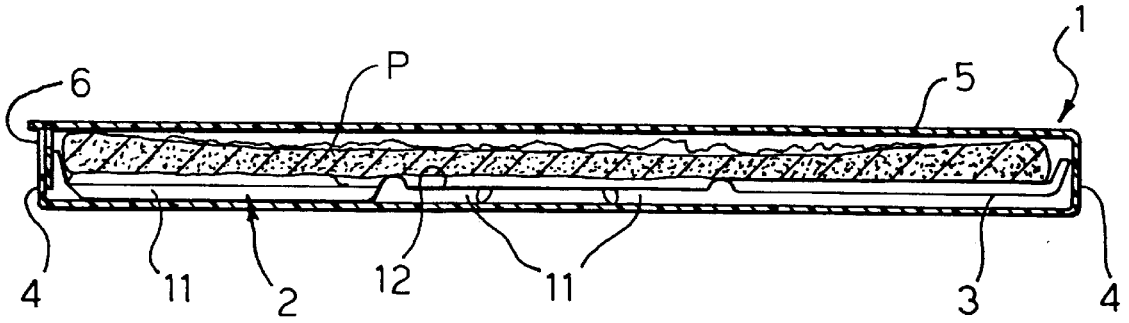
FIG. 4 is a vertically sectioned diagrammatic view of the container in use.

The first radial ribs 9 and 10 act as support/spacer element for the pizza P or the like placed in the tray 2, such as depicted in FIG. 4. When the pizza P or the like is bearing thereon, cavities are defined between the pizza P and the base wall 7 of the tray 2 which are acting as chimneys for discharging smoke and steam produced by the pizza P or the like.

The second ribs, designated as 11, provide a primary function of defining, on the upper face of the base wall 7 of the tray 2, channels situated at a lower level with respect to the general plane of such base wall 7 for collecting any steam generated by the pizza P or the like and condensed.

These channels communicate in use with the chimneys delimited, as previously pointed out, between the first ribs 9 and 10.

The second ribs 11 further provide the additional functions of both supporting and keeping the tray 2 in a spaced-apart condition relative to the bottom wall 3 of the box 1, and ensuring joint coupling between the tray 2 and identical trays in a mutually superimposed and stacked condition.

Naturally the sides of the tray 2 will be such to provide easy introduction and withdrawal thereof relative to the box 1, with the pizza P or the like resting thereupon, such as shown in FIG. 4.

The combination between the box and the tray 2 provide a container which, while being adapted to be simply and cheaply manufactured, ensures in a surprising way preserving heat and fragrance of the pizza P or the like housed therein, substantially without any contaminations by moisture whose outlet toward the outside of the container is allowed by the presence of the openings 6, communicating with the interspace defined between the tray 2 and the bottom wall 3 of the box 1.

Figure 6:
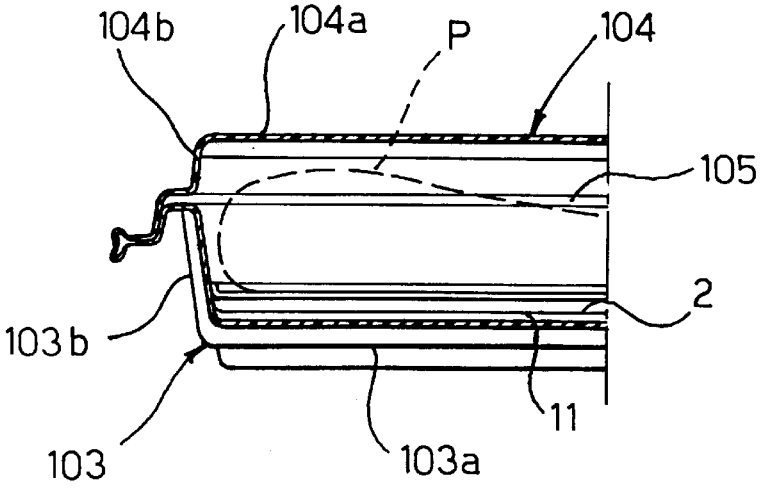
FIG. 6 is a partial and diagrammatic vertically sectioned view showing in an enlarged scale the container of FIG. 5 in use.
Figure 5:
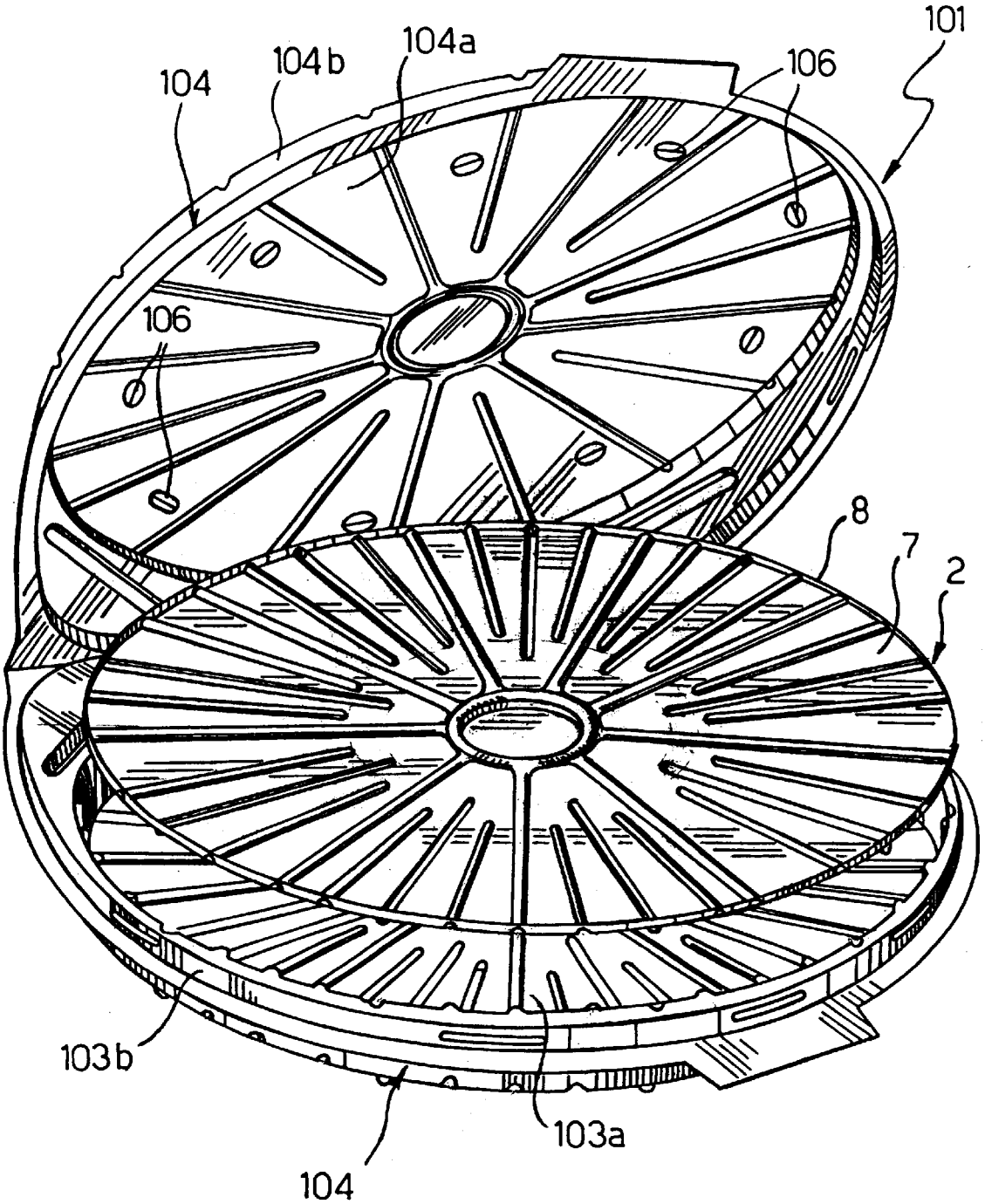
FIG. 5 is is an exploded perspective view of a container for transporting heated food according to an alternative embodiment of the invention.

In the variant depicted in FIGS. 5 and 6 the tray 2 is almost identical to the one previously disclosed, while the outer vessel, generally designated as 101, is generally corresponding to the one disclosed and illustrated in EP-A-0 989 067 already mentioned in the above, whose contents are considered herein incorporated for the sake of brevity. In connection with the present invention it is sufficient to point out that The outer vessel is almost corresponding to that shown and disclosed in EP-A-0989067 already mentioned in the above and to which reference is made for brevity. In connection with the present invention, it is sufficient to point out that the outer vessel consists of a single body of heat-formed plastic material defining a first half-shell 103 constituting a base and a second half-shell 104 constituting an openable lid, each of which has a respective bottom wall 103*a*, 104*a* and respective lateral walls 103*b*, 104*b*. The lateral walls 103*b*, 104*b* are formed with respective coupling members for substantially sealed mutual connection so as to define, in the closed condition between the two half-shelves 103, 104, a cavity for housing the foddstuffs, referenced as 105 in FIG. 6 and communicating to the outside through vent openings 106 of the lid 104.

In the condition of use shown in FIG. 6 the inner tray 2, on which the pizza P is resting, is fitted within the lower half-shell 103 bearing on the bottom wall 103*a* while being spaced-apart therefrom, thus avoiding direct heat transmission between the pizza P and the bottom of the container, formed by the wall 3*a* itself. This prevents thermal deformations of the lower half-shell 3 and overheating thereof which might negatively affect transportation by the user.

Naturally the details of construction and the embodiments may be widely varied with respect to what has been disclosed and illustrated, without thereby departing from the scope of the present invention such as defined in the appended claims.

What is claimed is:

1. A container for transporting heated food, particularly pizza (P) and the like, comprising in combination:

an outer vessel (1; 101) having a bottom wall (3; 103), an openable lid (5; 104) and apertures (6; 106) communicating to the outside, and an inner receptacle formed by a plastic-material tray (2) to be fitted within said outer vessel (1; 101), said tray (2) having a base wall (7) and a raised perimetral edge (8), said base wall (7) having un upper face and a lower face and being provided with a plurality of first and second ribs (9, 10; 11) projecting from the upper face and from the lower face, respectively, of said base wall (7), said first ribs (9, 10) acting in use as support/spacer elements for the pizza (P) or the like relative to the upper face of said base wall (7) and defining therebetween cavities acting as chimneys for discharging smoke and steam, and said second ribs (11) acting as support/spacer elements between said tray (2) and said bottom wall (3; 103) of said outer vessel (1; 101), said second ribs (11) further defining on the upper face of said tray (2) collecting channels for any condensed steam communicating with said chimneys for discharging smoke and steam.

2. Container according to claim 1, wherein said first and second ribs (9, 10; 11) are arranged in a radial array fashion.

3. Container according to claim 1, wherein said first ribs (9, 10) are alternatively longer and shorter.

4. Container according to claim 3, wherein said first longer ribs (9) and said second ribs (11) depart from a central annular rib (13) circumscribing a flat surface (12) on said base wall (7) of said tray (2).

5. Container according to claim 1, wherein said tray (2) is formed by a thin heat-formed polypropylene sheet.

6. Container according to claim 1, wherein said outer vessel is a cardboard box (1).

7. Container according to claim 1, wherein said outer vessel (101) is constituted by a first and a second half-shells (103, 104) of moulded plastic material defining said base and said openable lid, respectively, and each having a respective bottom wall (103*a*, 104*a*) and respective lateral walls (103*b*, 104*b*) adapted to be mutually connected to each other in a substantially sealed condition so as to define, in the coupled condition, a cavity (105) for housing the pizza or the like and communicating to the outside through vent openings (106), said tray (2) being adapted to be fitted within said first half-shell (103) so as to bear upon the bottom wall (103*a*) thereof through said second ribs (11).

* * * * *